United States Patent [19]

Lenders

[11] 4,291,840

[45] Sep. 29, 1981

[54] DEVICE FOR THE WINDING OF COILS

[75] Inventor: Wilhelmus L. L. Lenders, Eindhoven, Netherlands

[73] Assignee: U.S. Philips Corporation, New York, N.Y.

[21] Appl. No.: 79,846

[22] Filed: Sep. 28, 1979

[30] Foreign Application Priority Data

Oct. 2, 1978 [NL] Netherlands ..... 7809906

[51] Int. Cl.[3] ..... H01F 11/04

[52] U.S. Cl. ..... 242/7.14; 242/7.05 B

[58] Field of Search ..... 242/7.14, 7.05 B, 83; 140/92.1

[56] References Cited

U.S. PATENT DOCUMENTS 1,054,891 3/1913 Anderson ..... 242/7.14
3,101,180 8/1963 Sadorf ..... 242/7.14 X
3,106,351 10/1963 Fulton ..... 242/7.14
3,263,309 8/1966 Carman ..... 242/7.14 X
4,174,815 11/1979 Dammar ..... 242/7.05 B

FOREIGN PATENT DOCUMENTS 1232655 7/1957 Fed. Rep. of Germany .
1907922 2/1969 Fed. Rep. of Germany .

*Primary Examiner*—Edward J. McCarthy
*Attorney, Agent, or Firm*—Thomas A. Briody; William J. Streeter; Rolf E. Schneider

[57] ABSTRACT

Apparatus is provided for winding a coil of wire onto a rigidly arranged coil core. A wire guide is journalled in a winding disc and is traversable in the direction of the coil axis. A part is connected to the wire guide for cooperation over a portion of its circle of revolution with a surface of a structural member displaceable in the direction of the axis of rotation.

8 Claims, 7 Drawing Figures

Figure 1:
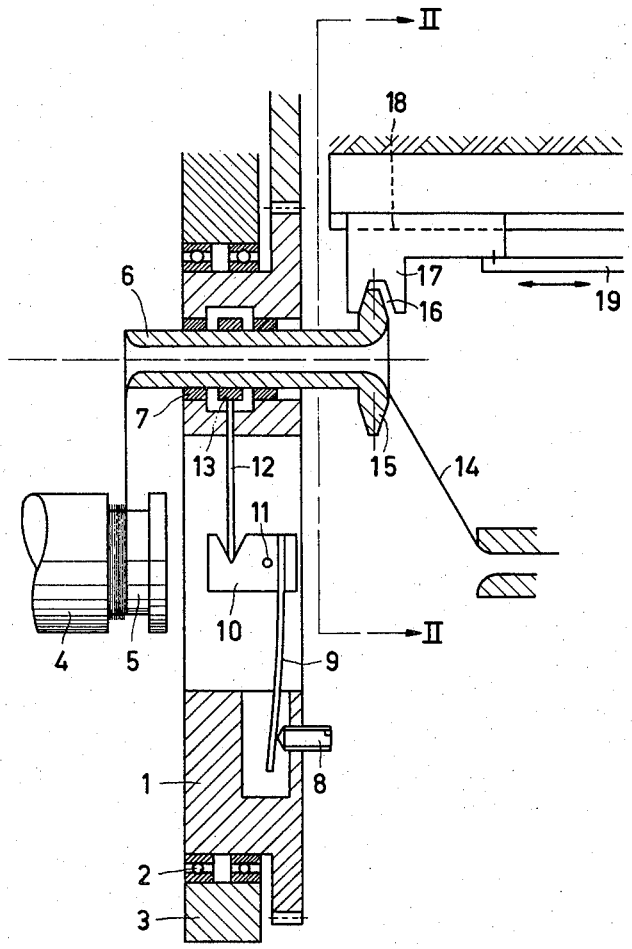

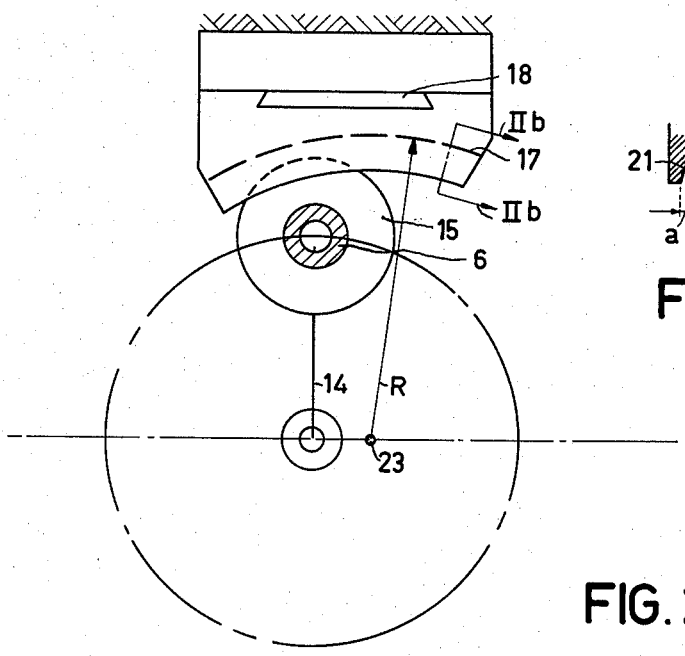
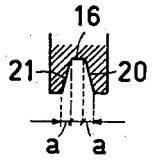
FIG. 2b
FIG. 2a
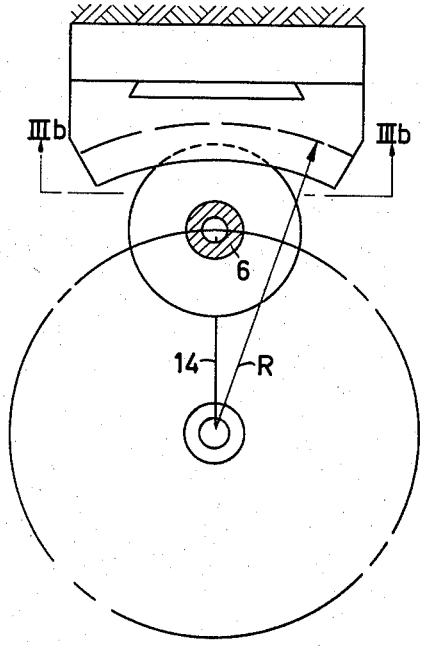
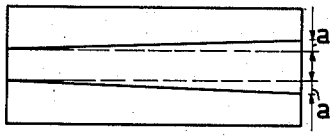
FIG. 3b
FIG. 3 a

DEVICE FOR THE WINDING OF COILS

This invention relates to a device for the winding of coils, in which at least one wire is wound from a supply, via a wire guide which is supported by a winding disc or a winding arm and which is traversable in the direction of the coil axis, onto a rigidly arranged coil core.

For the winding of a coil during which the coil itself does not rotate but the wire guide rotates around the coil instead, a wire guide in the form of a tube or a wheel is customarily connected to a wheel or a disc which in its turn is connected to a hollow shaft. This hollow shaft is arranged approximately on a prolongation of the coil axis. Winding devices of this kind are known from German Auslegeschrift No. 1,907,922 and German Pat. No. 1,232,655. In order to obtain regularly wound coils by means of these winding devices, the wire guide and the wheel or the disc whereto it is connected are moved in the axial direction. This movement is usually uniform with respect to the angular velocity and its direction is reversed at the flanges of the coil. This implies that the acceleration and the deceleration occurring at these areas should in theory be infinitely high. Because this cannot be achieved in practice, a deviation from the desired movement will occur. The extent of this deviation depends on the mass of the moving part, the velocity, and the play and the rigidity of the coupling of this part to the drive.

The present invention has for its object to minimize the mass of the moving wire guide in order to achieve adequate accuracy also at higher speeds.

In order to attain this object, the device in accordance with the invention is characterized in that the wire guide is journalled in the winding dics or arm to be slidable transversely of the direction of rotation, a part which is connected to the wire guide cooperating over a portion of its circle of revolution with a surface of a structural member which is displaceable in the direction of the axis of rotation. Movement of the wire guide with respect to the winding disc is thus realized. The wire guide mass to be displaced is thus minimized, so that an accurate movement can be achieved also at high speeds.

In a further embodiment of the device in accordance with the invention, the axially displaceable structural member has two surfaces, one of which cooperates with said part of the wire guide during displacement in one direction, whilst the other surface cooperates with said part during displacement in the opposite direction. The wire guide can thus be controlled in two directions.

In another embodiment, said part of the wire guide is constructed to be double-conical in shape.

The axially displaceable structural member in a still further embodiment is constructed as a segment provided with a groove for engagement by the double-conical part.

In order to realize displacement of the wire guide over the desired pitch of the turns, the groove may be helical or may extend perpendicularly to the axis of the winding disc, the radius of curvature of the groove then being greater than the radius of revolution of the double-conical part of the wire guide, the centres of both radii being so situated with respect to each other that, upon sliding of the segment, the double-conical part of the wire guide, after having come into cotact with one of the flanks of the groove, is forced up or down against this flank.

In this embodiment, the double-conical part of the wire guide contacts the flanks of the groove only over part of its circle of revolution. The double-conical part thus slides along the flanks of the groove, often causing substantial wear, notably at of high speeds.

In order to eliminate this problem, the axially displaceable structural member in a further embodiment in accordance with the invention comprises a slide accommodating at least one pair of opposed ball-bearings which form the surfaces with which the part connected to the wire guide cooperates. A further embodiment includes two flexible discs which rotate with the winding disc or arm and which respectively contact the ball-bearings during rotation, the part connected to the wire guide being situated between these discs. The friction and the wear between such part and the axially movable structural member are thus minimized.

In a still further embodiment, the wire guide has a tubular construction, the double-conical part being concentrically connected thereto. As a result of the friction between the double-conical part and the axially displaceable structural member, the tubular wire guide will turn slightly per revolution, so that any wear caused by the wire is uniformly distributed over the wire guide.

In order to ensure that the wire guide does not shift in its bearing when it is not in contact with the axially displaceable structural member, provision is made for adjusting the friction between the wire guide and its bearing arrangement.

Figure 4:
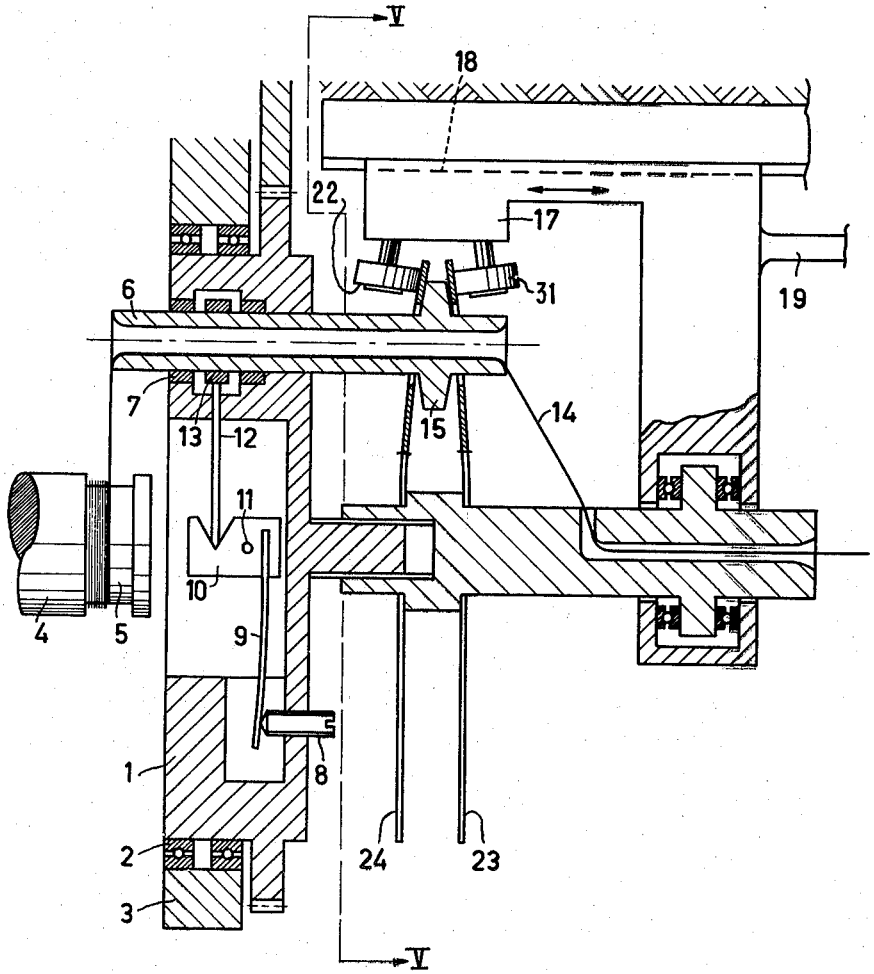
Figure 5:
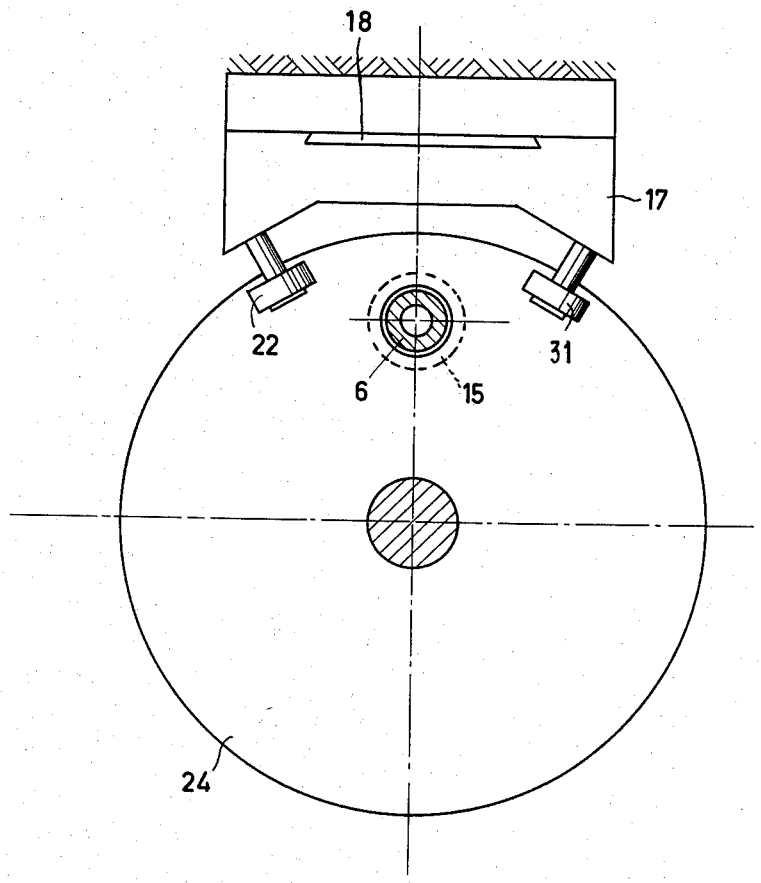

The invention wll now be described in detail diagrammatic with reference to the accompanying diagrammatic drawings, in which:

FIGS. 1 and 2*a* are two sectional views of a winding device, taken at right angles with respect to each other, with FIG. 2*a* being taken along the line II—II of FIG. 1, FIG. 2*b* is a sectional view taken along the line IIb—IIb of FIG. 2*a*, FIG. 3*a* is a sectional view, similar to FIG. 2*a*, of a modification of the winding device, FIG. 3*b* is a view taken along the line IIIb–IIIb of FIG. 3*a*, and FIGS. 4 and 5 are sectional views, again taken at right angles with respect to each other, with FIG. 5 being taken along the line V—V of FIG. 4, of a further embodiment of a winding device.

FIG. 1 shows a winding device, comprising a winding disc 1 which is journalled on bearings 2 in the frame 3 of the device. On a prolongation of the axis of the winding disc there is arranged a holder 4 on which a coil former 5 can be arranged.

Eccentrically in the winding disc 1, a wire guide 6 is journalled to be axially slidable. The bearing is denoted by the reference numeral 7. The friction between the wire guide 6 and its bearing 7 can be varied by means of a screw 8 which biases a spring 9 more or less. This spring 9 is secured to a tilting block 10 which is capable of tilting about a shaft 11 journalled in the winding disc. When the block 10 is tilted, the part 13 of the bearing for the wire guide 6 is loaded more or less, via the rod 12, for adjustment of the desired friction.

The wire guide 6 has a tubular construction with rounded portions on both sides, so that the wire 14 is substantially not subject to wear during its passage through the wire guide.

The wire guide 6 includes a double-conical part 15. This part fits in the groove 16 of a segmentshaped structural member 17. The structural member 17 is movably journalled on a guide 18 and is connected, via a rod 19, to a drive (not shown) which moves the segment 17 during each revolution of the winding disc over a distance equal to the desired pitch of the wire turns on the coil 5.

The groove 16 is shaped so that at the area of the run-in the double conical part 15 has an axial play which is equal to at least twice the desired pitch of the coil to be wound.

Each of the flanks of the groove consequently extends at an angle with respect to the plane perpendicular to the axis of rotation over a distance equal to the pitch of the turns, so that the groove becomes inereasingly narrower until there is substantially no play left between the part 15 and the groove 16 at the area of the run-out.

The foregoing can be structurally realized in two ways. The first case utilizes a groove 16 of constant section. The flanks 20 and 21 then extend in the direction of rotation of the part 15, each flank being inclined so that the distances a correspond to the pitch of the turns. The radius of curvature R of the groove 16 is larger than the radius of the circle of revolution of the part 15. Furthermore, the centre of curvature 23 is situated to the right of the centre of rotation of the part 15, with the result that during rotation the part 15 first contacts the outermost point of the flank 20 or 21 and subsequently increasingly penetrates the groove while sliding along the relevant flank until ultimately it has been shifted in the axial direction over a distance which equals the pitch.

In the second case, the centre of the groove is the centre of rotation of the part 15, so that the distance between the part 15 and the groove 16 does not change during rotation. In order to realize the shifting of the part 15 in the axial direction, the flanks 20 and 21 of the groove extend transversely of the plane in which the part 15 rotates. The groove 16 is then as shown in the plan view of FIG. 3*b*, which clearly illustrates that the inclination of the flanks is such that the distances a again correspond to the pitch.

After each turn during winding, the wire guide will thus be axially shifted by the structural member 17 over a distance which corresponds to the pitch of the turns. The structural member 17 can then move continuously. The wire guide 6, having a minimum mass, is step-wise moved, so that the largest part of each turn is situated in a plane perpendicular to the coil axis. Due to the friction between the part 15 and the groove 16, the tubular wire guide will each time be slightly turned in its bearing, so that the wear of the tube at the areas of the run-in and the run-out of the wire is uniformly distributed over the tube circumference.

In this embodiment, the double-conical part 15 is in frictional contact with the flank of the groove 16 during part of its circle of revolution. This may cause problems, notably at high speeds.

In order to mitigate these problems, the embodiment of the winding device shown in FIGS. 4 and 5 is provided with two pairs of opposed ball-bearings 31 and 22 associated with the structural member 17. Two discs or plates 23 and 24 are rotatably arranged between and in contact with the ball-bearings, said plates being driven by a shaft connected to the winding disc.

The distance between these two plates at the area of their connection to the shaft is greater than the distance between the opposed ball-bearing pairs. This means that the double-conical part 15 runs clear of the plates 23 and 24 for the major part of its circle of revolution, and contacts the plates 23 and 24 only between the opposed ball-bearing pairs. However, because these ball-bearing pairs rotate, substantially no friction or wear occurs between the part 15 and the plates 23 and 24.

What is claimed is:

1. Apparatus for winding a coil of wire onto a rigidly arranged coil core, which comprises a winding member rotatable about an axis; a wire guide journalled in the winding member and traversable in the direction of the axis of rotation; a structural member displaceable in the direction of the axis of rotation; and an element connected to the wire guide and cooperating over part of its circle of revolution with a surface of the structural member.

2. Apparatus according to claim 1, in which the axially displaceable structural member has two surfaces, one cooperating with said element of the wire guide during displacement of the structural member in one direction, the other cooperating with said element during displacement of the structural member in the opposite direction.

3. Apparatus according to claim 2, in which said element of the wire guide is double-conical in shape.

4. Apparatus according to claim 3, in which the axially displaceable structural member is provided with a groove for engagement by the double-conical element of the wire guide.

5. Apparatus according to claim 1, in which the axially displaceable structural member comprises a slide accommodating at least one pair of opposed ball-bearings forming the surfaces cooperating with the element connected to the wire guide.

6. Apparatus according to claim 5, which includes two flexible discs each rotatable with the winding member and being respectively in contact with the ball-bearings during rotation, the element connected to the wire guide being movable between the discs.

7. Apparatus according to claim 1, in which the wire guide has a tubular construction, the element connected thereto being concentric in shape.

8. Apparatus according to claim 1, which includes means for adjusting the friction of the journalling arrangement for the wire guide.

* * * * *